US009267767B2

(12) United States Patent
Hwang

(10) Patent No.: US 9,267,767 B2
(45) Date of Patent: Feb. 23, 2016

(54) SELF-DEFENSE SPRAY MANUFACTURED IN VARIOUS DESIGNS WITH PORTABILITY

(71) Applicant: In-Cheol Hwang, Seoul (KR)

(72) Inventor: In-Cheol Hwang, Seoul (KR)

( * ) Notice: Subject to any disclaimer, the term of this patent is extended or adjusted under 35 U.S.C. 154(b) by 283 days.

(21) Appl. No.: 13/975,700

(22) Filed: Aug. 26, 2013

(65) Prior Publication Data

US 2014/0166782 A1 Jun. 19, 2014

(30) Foreign Application Priority Data

Dec. 14, 2012 (KR) ..... 10-2012-0146356

(51) Int. Cl.
*F41H 9/10* (2006.01)
*B05B 7/24* (2006.01)
*B05B 12/00* (2006.01)

(52) U.S. Cl.
CPC ..... *F41H 9/10* (2013.01); *B05B 7/2405* (2013.01); *B05B 7/2416* (2013.01); *B05B 7/2418* (2013.01); *B05B 12/002* (2013.01)

(58) Field of Classification Search
CPC .. B05B 7/2405; B05B 7/2416; B05B 7/2418; B05B 12/002; B65D 83/20; F16H 9/10
See application file for complete search history.

(56) References Cited

U.S. PATENT DOCUMENTS

| | | | | |
|---|---|---|---|---|
| 5,192,009 | A * | 3/1993 | Hildebrandt et al. | 222/400.5 |
| 5,709,320 | A * | 1/1998 | Jimenez | 222/175 |
| 5,799,828 | A * | 9/1998 | Crawford | 222/79 |
| 5,921,442 | A * | 7/1999 | Keller et al. | 222/153.13 |
| 2005/0045745 | A1 * | 3/2005 | Kutay et al. | 239/419 |
| 2006/0091238 | A1 * | 5/2006 | Kutay et al. | 239/373 |

* cited by examiner

*Primary Examiner* — Ryan Reis
(74) *Attorney, Agent, or Firm* — Jefferson IP Law, LLP

(57) ABSTRACT

A portable self-defense spray to protect a person from danger under an emergency situation is provided. The compressive-spray structure includes a compact case manufactured in various designs by using a flexible long-length filling tube filled with the CN solution. In a typical spray structure, CN solution is always sprayed at only a right position, the filled CN solution is not completely exhausted, and the design of the self-defense spray is limited. The filling tube to receive the CN solution is provided in the case without being twisted. The vacuum pump operating member cooperating with the button member having the spray port is installed at one side of the filing tube. A cap is provided at an opposite side of the filling tube for the sealing purpose. Vacuum is generated with the pressing of the button member, so that the CN solution in the filling tube is sprayed due to compression.

7 Claims, 9 Drawing Sheets

SELF-DEFENSE SPRAY MANUFACTURED IN VARIOUS DESIGNS WITH PORTABILITY

CROSS-REFERENCE TO RELATED APPLICATION(S)

This application claims the benefit under 35 U.S.C. §119 (a) of a Korean patent application filed on Dec. 14, 2012 in the Korean Intellectual Property Office and assigned Serial No. 10-2012-0146356, the entire disclosure of which is hereby incorporated by reference.

TECHNICAL FIELD

The present disclosure relates to a portable self-defense spray capable of protecting a person from danger under an emergency situation. More particularly, the present disclosure relates to a structure of spraying CN solution by compressive force, in which a compact case can be manufactured in various designs by using a filling tube including a silicon material and the CN solution can be sprayed in any direction based on compressive spraying resulting from vacuum.

BACKGROUND

Recently, when a person is in danger such as kidnapping and robbery, the person has reported the danger to the policy by using a cellular phone carried by the person. However, when the danger is reported by using the cellular phone, the person cannot rapidly manipulate the cellular phone for the report of the danger to the policy, and cannot rapidly cope with the danger to be personally applied to the person. In addition, the person has no countermeasure against the danger to be applied until the policy reaches the site after the police has been reported and dispatched.

The dangerous situation more seriously happens to women, which are more easily exposed to crimes, than men.

Accordingly, many portable self-protection articles have been provided. Among them, a self-defense spray has been mainly used to rapidly cope with the dangerous situation due to a small size, portability, and simple operation.

The self-defense spray has a structure of spraying CN solution, which is received in a receiving part provided in a case, to a spray port through an introduction tube, which is provided perpendicularly to the receiving part, as a button is pressed.

However, the self-defense spray has following disadvantages. Since most introduction tubes are separated from a bottom surface to some degree without completely making contact with the bottom surface in order to smoothly introduce the CN solution received in the receiving part, the CN solution remains on the bottom surface. In addition, when the spray is inclined for use, the CN solution is not smoothly introduced into the filling tube provided perpendicularly to the receiving part, so that the spray is not actually used.

Therefore, according to Korean Patent Registration No. 10-1078154 registered after being applied by an applicant of the present disclosure in order to improve the above problem, a case provided at the front portion thereof with a spray port includes a storage vessel filled with CN solution and having a rubber packing and the spray port having a vacuum pump operating member, so that the CN solution may be sprayed in any direction through a vacuum pump scheme if a press member is pressed.

However, since the case has a structure in which the storage vessel to receive the CN solution and the vacuum pump operating member are aligned in line with the spray port, the shapes of the self-defense spray are not various, but limited and crude, so that the user has resistance against the use of the spray.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a self-defense spray which can be manufactured in various designs in compact size and can be sprayed received CN solution in any direction without residual CN solution.

According to an aspect of the present disclosure, a filling tube having a long length and including a flexible material such as silicon or a rubber material so that the filling tube is freely bent to receive CN solution in a case is guided so that the filling tube is not twisted. A vacuum pump operating member is installed at one side of the filling tube to spray the CN solution based on compression resulting from the vacuum pump as a button member having a spray port is pressed, and a filling cap is provided at an opposite side of the filling tube for the purpose of filling the CN solution. Accordingly, if the button is pressed, the filling tube is compressed through the vacuum pump operation, so that the filled CN solution is sprayed through the spray port.

According to another aspect of the present disclosure, when a coil spring is installed in the filling tube to guide the filling tube so that the filling tube is not twisted in the case, the filling tube is prevented from being bent, so that the filled CN solution is smoothly sprayed.

According to another aspect of the present disclosure, the CN solution is filled in the filling tube and sprayed through a compressive scheme, so that the CN solution can be sprayed in any direction of up, down, left and right and the filled CN solution can be sprayed without the residual amount. Accordingly, the waste of the CN solution can be reduced. In addition, the self-defense spray can be designed in a compact size and various shapes, so that the product quality can be improved and the incompatibility can be reduced. Accordingly, the product value can be raised.

Other aspects, advantages, and salient features of the disclosure will become apparent to those skilled in the art from the following detailed description, which, taken in conjunction with the annexed drawings, discloses various embodiments of the present disclosure

BRIEF DESCRIPTION OF THE DRAWINGS

The above and other aspects, features, and advantages of certain embodiments of the present disclosure will be more apparent from the following description taken in conjunction with the accompanying drawings, in which.

The same reference numerals are used to represent the same elements throughout the drawings.

DETAILED DESCRIPTION

Figure 1:
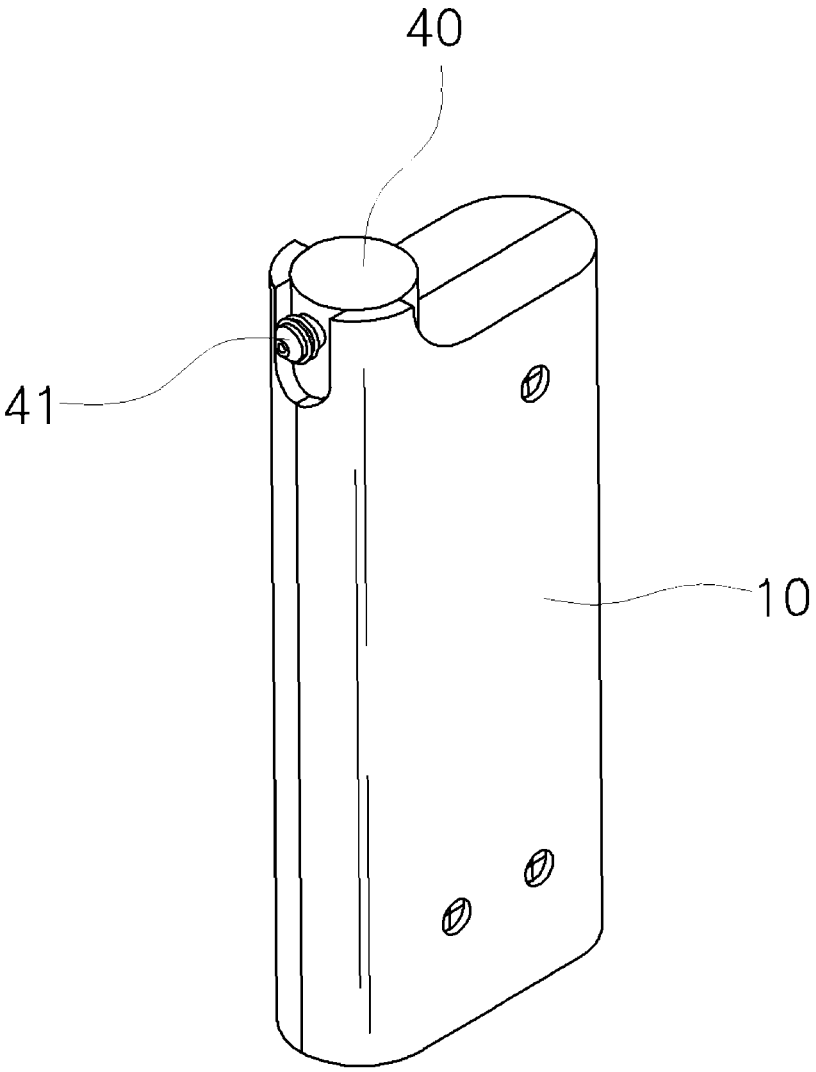
FIG. 1 is a perspective view showing an outer appearance of a self-defense spray according to an embodiment of the present disclosure.
Figure 2:
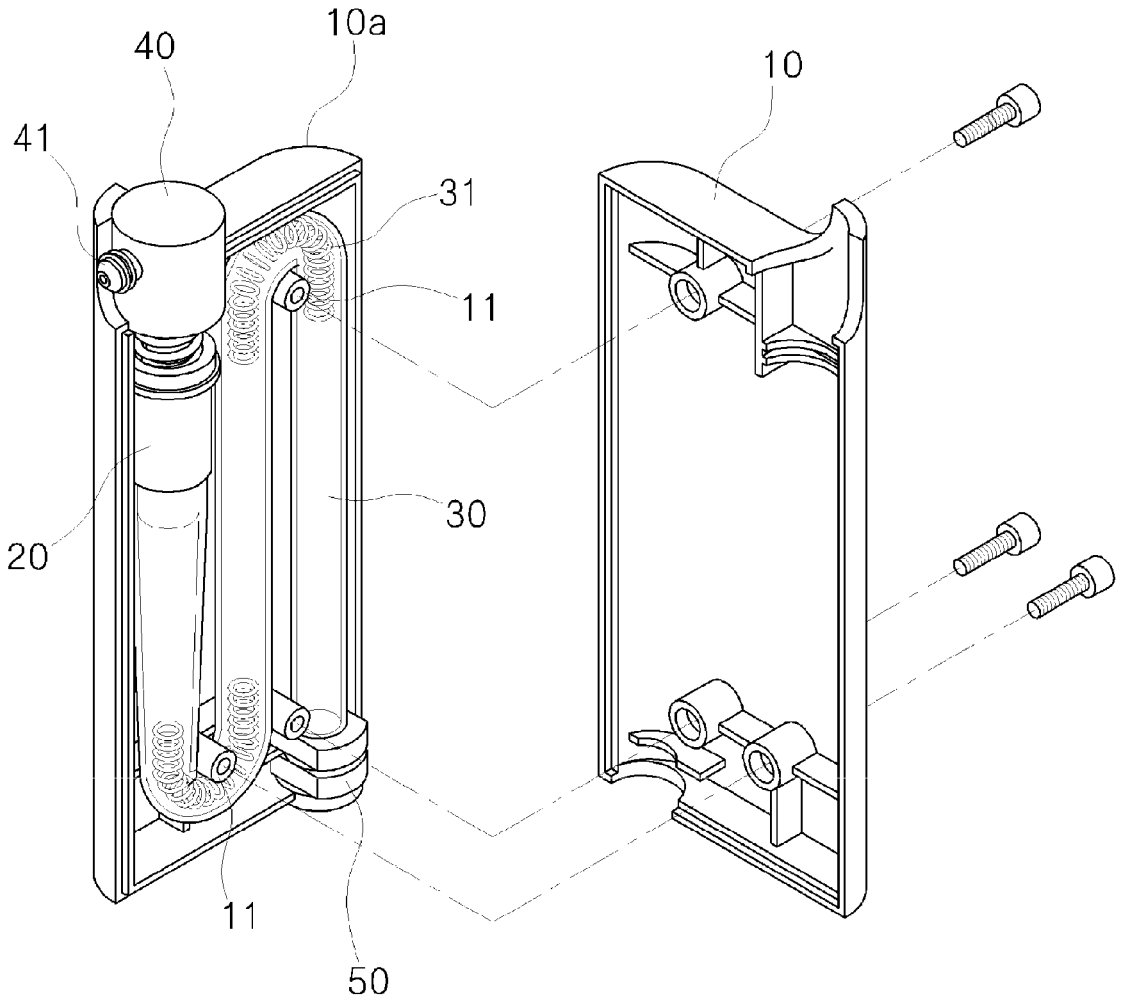
FIG. 2 is an assembling perspective view showing the spray structure of the self-defense spray according to an embodiment of the present disclosure.
Figure 3:
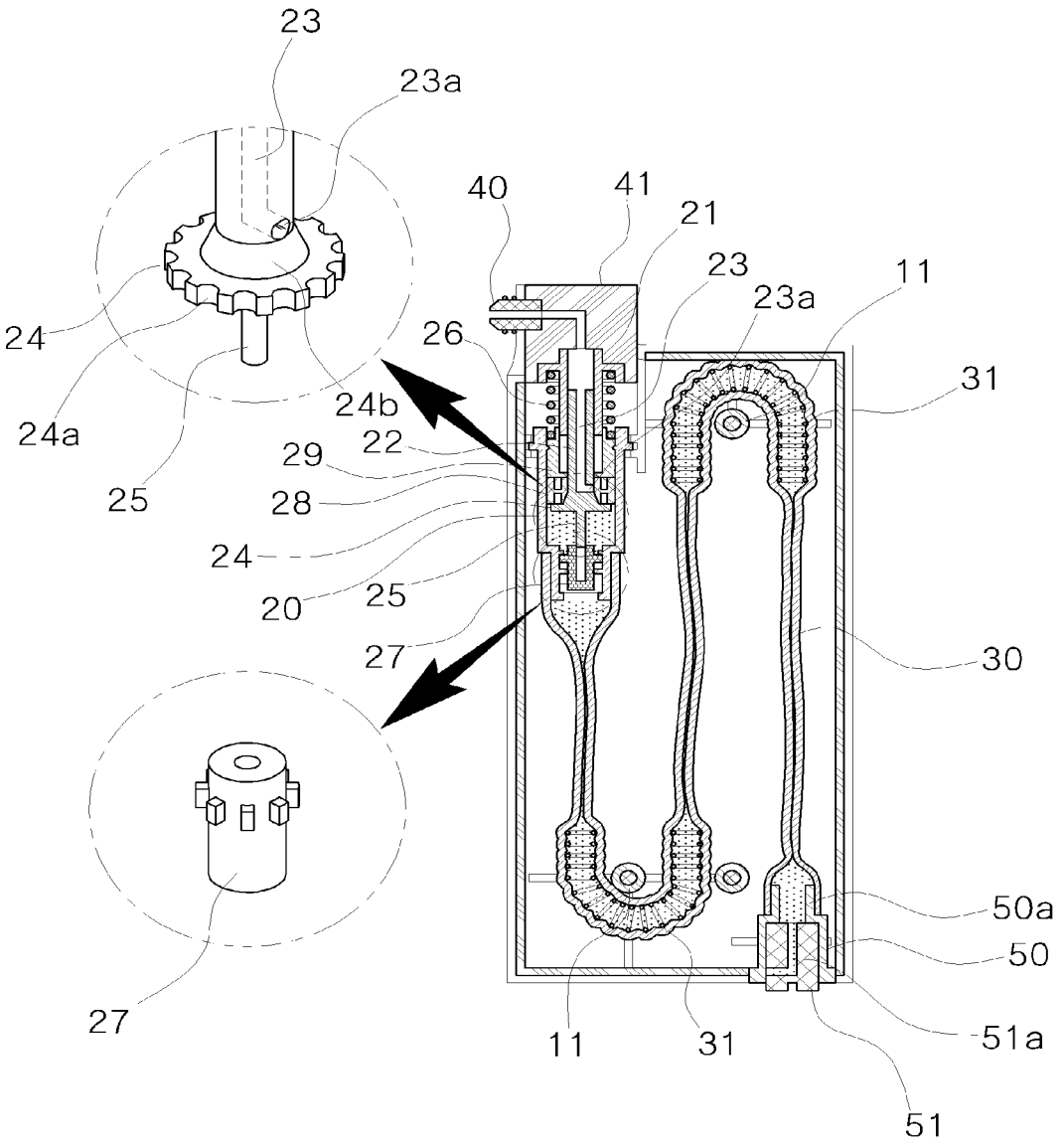
FIG. 3 is an assembling sectional view showing the self-defense spray according to an embodiment of the present disclosure.
Figure 4:
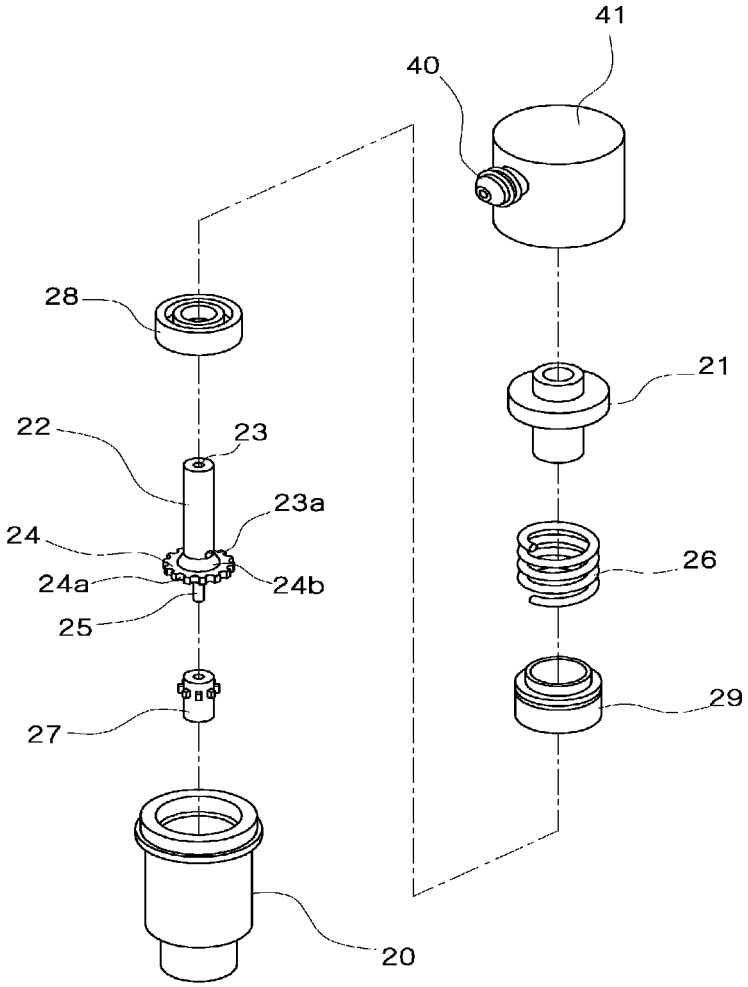
FIG. 4 is an exploded perspective view showing the structure of a vacuum pump operating member to generate vacuum according to an embodiment of the present disclosure.
Figure 5:
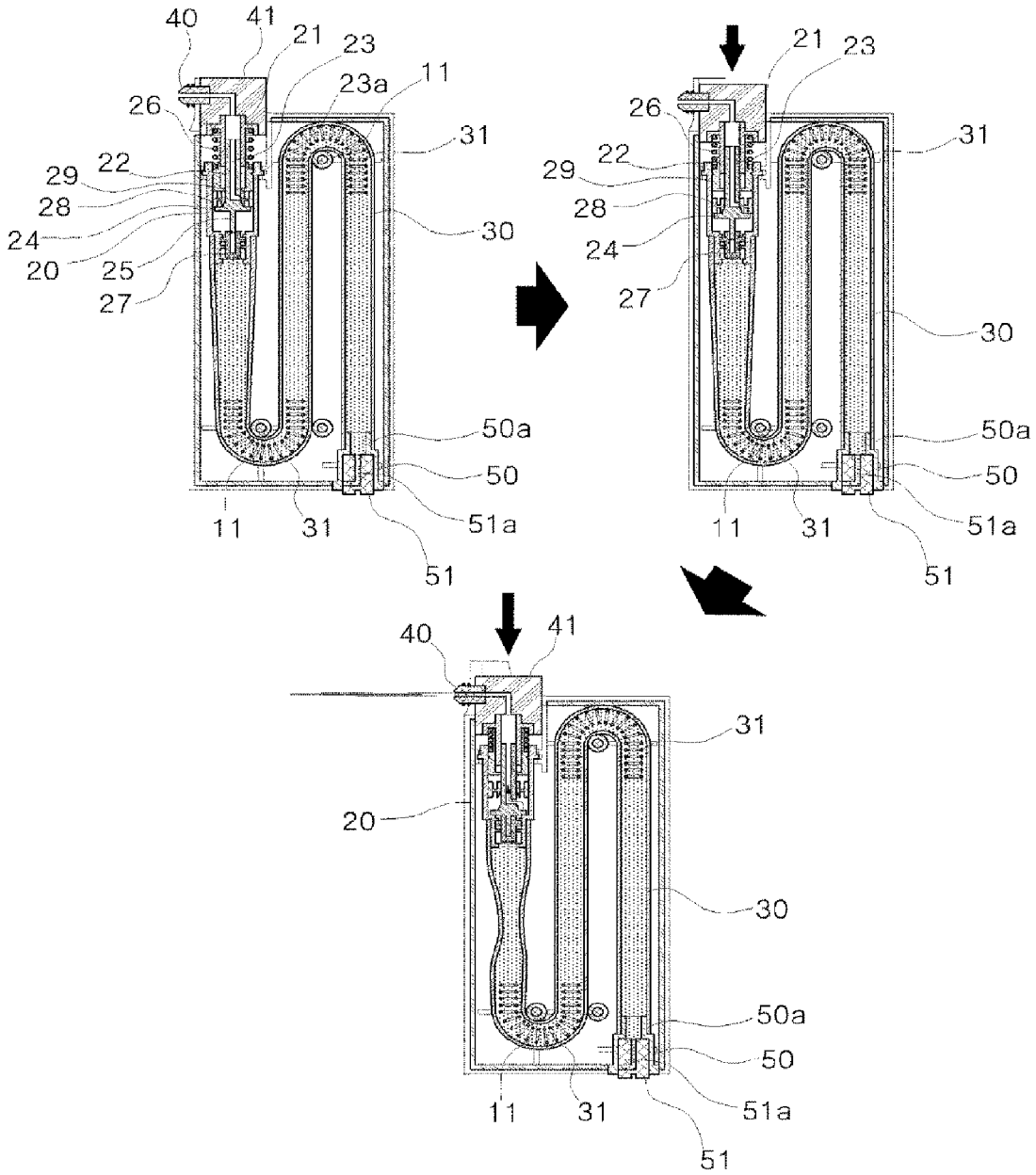
FIG. 5 shows sectional views of the spray structure of the self-defense spray according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Referring to FIGS. 1 to 5, in a self-defense spray according to various embodiments of the present disclosure, a filling tube 30, which is filled with CN solution and includes a long tube, is installed in a case 10 prepared as a separable assembly, a vacuum pump operating member 20 cooperating with a button member 40 having a spray port 41 is installed at one side of the filling tube 30, and a cap 50 is installed at an opposite side of the filling tube 30 so that the cap 50 is sealed. Accordingly, a vacuum state is formed through a pressing operation of the button member 40 so that the filling tube 30 is compressed by compressive force to make the filled CN solution sprayed.

In this case, the filling tube 30 includes a flexible material such as rubber or silicon, so that the filling tube 30 may be freely bent. The filling tube 30 has a long tube so that the CN solution is sufficiently filled therein. The filling tube 30 includes a rubber material or a silicon material so that the filling tube 30 may be freely bent. Accordingly, the self-defense spray may be manufactured in various shapes in compact size so that the self-defense spray may be portable.

Figure 6:
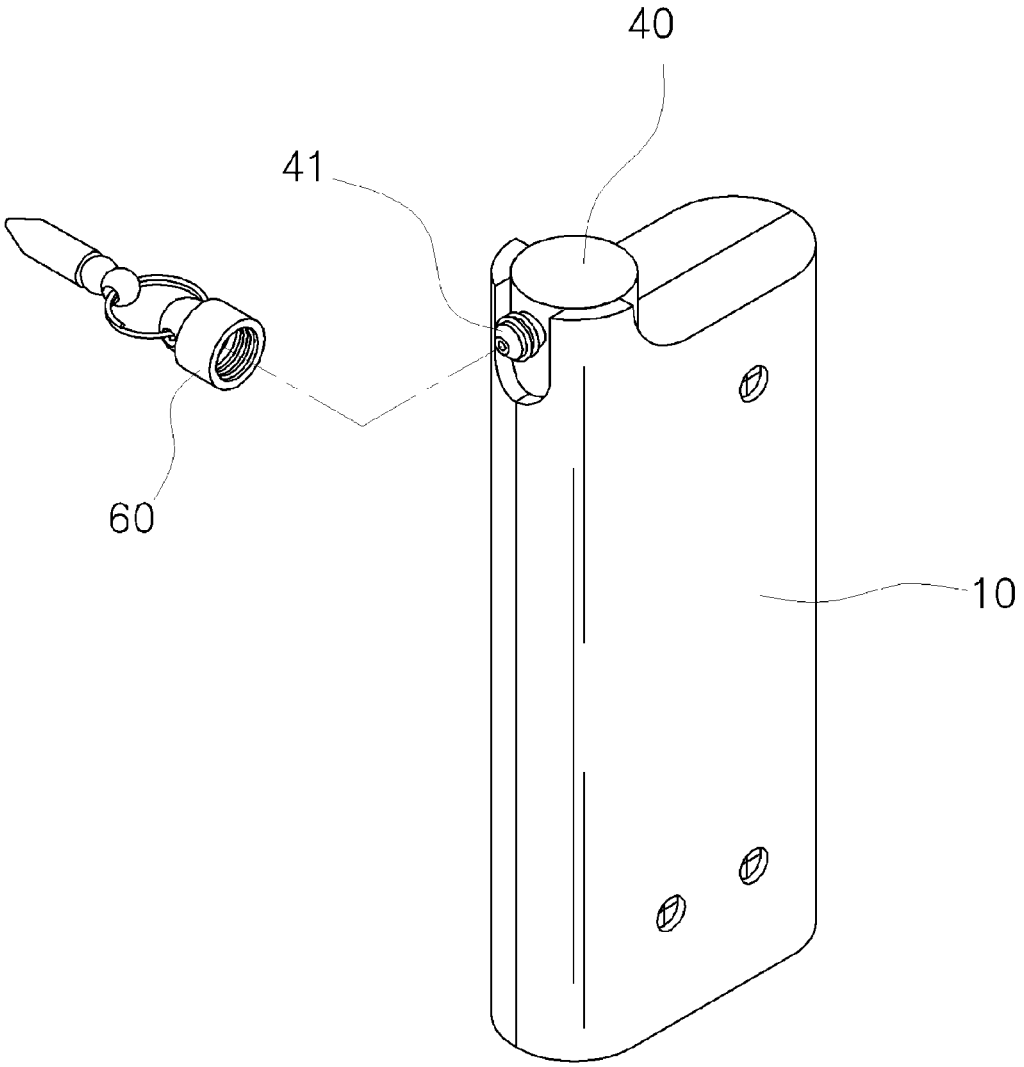
FIG. 6 is a perspective view showing a cap fitted around a spray port according to an embodiment of the present disclosure.
Figure 7:
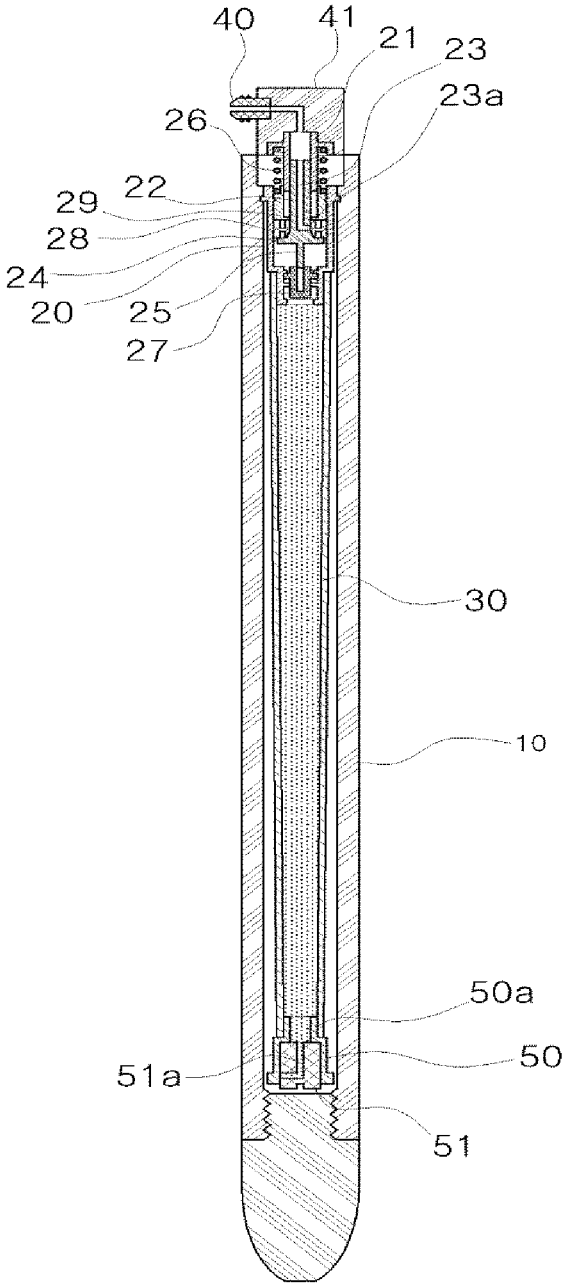
FIG. 7 is a sectional view showing another structure of a self-defense spray according to an embodiment of the present disclosure.
Figure 8:
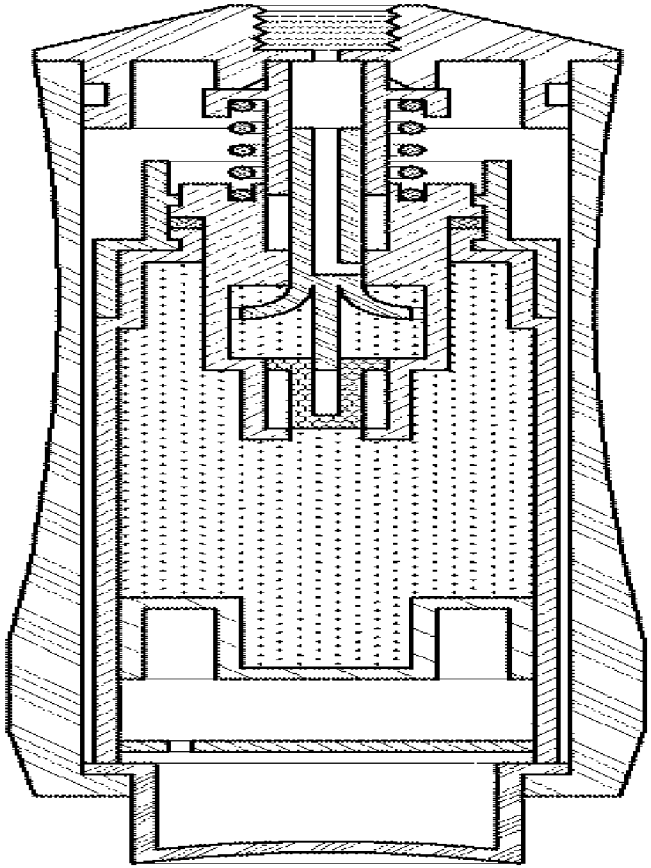
FIG. 8 is a sectional view showing a self-defense spray according to an embodiment of the present disclosure.
Figure 9:
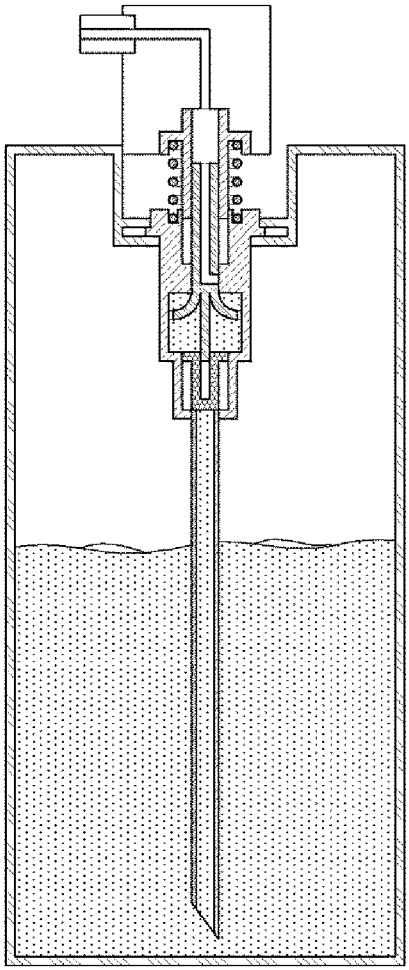
FIG. 9 is a sectional view showing a self-defense spray based on a compression spray scheme according to an embodiment of the present disclosure.

FIG. 6 is a perspective view showing a cap fitted around a spray port according to an embodiment of the present disclosure, FIG. 7 is a sectional view showing another structure of a self-defense spray according to an embodiment of the present disclosure, FIG. 8 is a sectional view showing a self-defense spray according to an embodiment of the present disclosure, and FIG. 9 is a sectional view showing a self-defense spray based on a compression spray scheme according to an embodiment of the present disclosure.

Meanwhile, in order to prevent the filling tube 30 having the CN solution therein with a sufficiently long length from being twisted in the compact case 10, a protrusion part 11 is formed at a bending portion of the filling tube 30, so that the protrusion part 11 guides the filling tube 30 to prevent the filling tube 30 from being twisted.

In addition, in order to prevent the filling tube 30 from being clogged as the filling tube 30 is guided by the protrusion part 11 and bent, a coil spring 31 is provided in a portion of the filling tube 30 positioned corresponding to the protrusion part 11 and bent, so that the filled CN solution may be smoothly sprayed.

In this case, the vacuum pump operating member 20, which is installed at one side of the filling tube 30 to form a vacuum state, comprises a tube perforated at the center thereof, is provided at an inner upper portion thereof with a fixing tube 29 and at a lower portion thereof with an introduction tube 27. A supply tube 22 having a supply passage 23 communicating with an introduction hole 23*a* formed through a lower portion of the fixing tube 29 is axially installed in at the center of the fixing tube 29 so that the CN solution is supplied to the spray port 41 formed in the button member 40. An operating tube 21 is installed at a portion of the supply tube 22 in which the supply passage 23 is formed. The operating tube 21 is positioned at the upper portion of the vacuum pump operating member 20. A spring 26 is interposed between the operating tube 21 and the vacuum pump operating member 20 so that the button member 40 may be repeatedly pressed.

The supply tube 22, which is axially formed at the center of the fixing tube 29, includes a locking rim 24 which is formed at a lower end having the introduction hole 23*a* communicating with the supply passage 23 to tightly make contact with the inner wall surface of the vacuum pump operating member 20 and provided at an outer circumferential surface thereof with grooves 24*a* spaced apart from each other by a predetermined interval. The locking frame 24 is provided at the lower end thereof with a guide rod 25 fitted into the center of the introduction tube 27 formed at the lower portion of the vacuum pump operating member 20 to perform a guide operation, so that the supply tube 22 may perform a stable pumping operation. A packing 28 is positioned between the upper portion of the locking rim 24 and the fixing tube 29 so that the introduction hole 23*a* communicating with the supply passage 23 is sealed. Accordingly, if the button member 40 is pressed, vacuum is formed in the supply tube 22 so that the packing 28 is fixed by the vacuum while the sealed introduction hole 23*a* is open. Accordingly, the filling tube 30 is compressed due to the vacuum so that the CN solution is sprayed.

In this case, the packing 28 for sealing, the supply tube 22, and the introduction tube 27 may be installed inside the vacuum pump operating member 20 by the fixing tube 29 installed at the inner upper portion of the vacuum pump operating member 20. After the introduction tube 27, the supply tube 22, and the packing 28 are sequentially installed in the vacuum pump operating member 20 including a tube, the fixing tube 29 is axially installed in the supply tube 22, so that the fixing tube 29 is fixedly coupled with the vacuum pump operating member 20.

Therefore, if the button member 40 is pressed, the operating tube 21 cooperating with the button member 40 pumps up and down by the elastic of the spring 26 above the vacuum pump operating member 20. In this case, when the button member 40 is pressed, the operating tube 21 is pressed while the supply tube 22 axially installed in the fixing tube 29 is pressed, so that the pumping operation may be performed.

In addition, an inclined surface 24*b* is formed on a top surface of the locking rim 24 formed under the introduction hole 23*a* communicating with the upward-protruding supply passage 23 of the supply tube 223, and an inclined surface the same as the inclines surface 24*b* is formed at the inner wall of the packing 28 positioned at the top surface of the locking rim 24 and fitted to seal the introduction hole 23*a*. Therefore, as the supply tube 22 is pressed by the button member 40, the pumping operation is performed so that a vacuum pressure is generated. In this case, the packing 28, which is in the floating state, is stopped. In this case, as the supply tube 22 is more pressed, the inclined surface 24*b* is spaced apart from the corresponding inclined surface of the packing 28 which is engaged with the inclined surface. In this case, the introduction hole 23*a* is open so that the CN solution is introduced into the supply passage 23.

In this case, the CN solution may be filled in the filling tube 30, so that the filling tube 30 may be re-used several times.

To this end, if it is determined that the CN solution is completely exhausted by separating the cap 50 installed at an opposite side of the filling tube 30 to clog the opposite side of the filling tube 30, the opposite side of the filling tube 30 having no cap 50 is inserted into an additional container to receive the CN solution and a pumping operation is performed by consecutively pressing the button member 40. In this case, vacuum is generated from the vacuum pump operating member 20, so that the CN solution received in the additional container is automatically sucked into the filling tube 30 by the compressive force, so the filling tube is filled with the CN solution.

Further, in order to fill the CN solution in the state that the cap 50 is not separated, the cap (50) includes a tube having the form of a through hole, and has one side formed therein with a coupling tube 50*a* communicating with the filling tube 30 and an opposite side formed at an inner wall surface thereof with a thread so that a fastening member 51 having a thread is screwed with the inner wall surface from the outside to seal and finish the cap 50. Accordingly, as the fastening member 51 is open/closed through the screw-fastening scheme, the CN solution can be easily filled.

In addition, a fluid passage hole may be formed in one side of the fastening member 51, and the fastening member 51 is not completely separated from the cap 50, but separated to the extent that the fluid passage hole is exposed through the screw-fastening adjustment, so that the CN solution may be easily filled.

Further, a cap 60 is fitted around the spray port 41 to prevent the CN solution from being sprayed as the button member 40 is randomly pressed.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A self-defense spray that is manufactured in various designs with portability and compressively sprays a CN solution as vacuum is generated by pressing a button member (40), the self-defense spray comprising:

a case (10) prepared as a separable assembly and filled therein with the CN solution; and a filling tube (30) provided in the case (10) and comprising a tube having a long length to fill the CN solution therein, wherein a vacuum pump operating member (20) installed at one side of the filling tube (30) and cooperating with the button member (40) having a spray port (41) exposed out of the case (10) to generate the vacuum through the pressing operation of the button member (40) such that the CN solution is compressively sprayed, wherein an opposite side of the filling tube (30) is clogged by a cap (50) to generate a compressive force due to the vacuum generated through a pump operation by the vacuum pump operating member (20) if the button member (40) is pressed to compress the filling tube (30) while spraying the filled CN solution through the spray port (41), wherein the vacuum pump operating member (20), which comprises a tube perforated at a center thereof, is provided at an inner upper portion thereof with a fixing tube (29) and at a lower portion thereof with an introduction tube (27), wherein a supply tube (22) having the shape of a tube and having a supply passage (23) to communicate with an introduction hole (23*a*) at a lower portion thereof is axially installed at a center of the fixing tube (29) such that the CN solution is supplied to the spray port (41) formed in the button member (40), wherein an operating tube (21) is installed at a portion of the supply tube (22) in which the supply passage (23) is formed such that the supply tube (22) pumps up and down together with the operating tube (21) through the pressing operation of the button member (40), wherein a spring (26) is interposed between an upper portion of the vacuum pump operating member (20) and the operating tube (21) such that the button member (40) is repeatedly pressed, wherein the supply tube (22), which is axially formed at the center of the fixing tube (29) installed in the vacuum pump operating member (20), includes a locking rim (24) which is formed at a lower end having the introduction hole (23*a*) communicating with the supply passage (23) to tightly make contact with an inner wall surface of the vacuum pump operating member (20) and which is provided at an outer circumferential surface thereof with grooves (24*a*) spaced apart from each other by a predetermined interval, wherein the locking frame (24) is provided at a lower end thereof with a guide rod (25) fitted into a center of the introduction tube (27) formed at a lower portion of the vacuum pump operating member (20) to perform a guide operation, and wherein a packing (28) is positioned between an upper portion of the locking rim (24) and the fixing tube (29) such that the introduction hole (23*a*) communicating with the supply passage (23) is sealed to form vacuum in the supply tube (22) if the button member (40) is pressed such that the packing (28) is fixed by the vacuum while the sealed introduction hole (23*a*) is open to compress the filling tube (30) due to the compressive force resulting from the vacuum such that the CN solution is sprayed.

2. The self-defense spray of claim 1, wherein the filling tube (30) comprises the tube having the long length and comprising rubber or a silicon material such that the filling tube (30) is freely bent.

3. The self-defense spray of claim 1, further comprising:

a protrusion part (11) formed in the case (10) to guide the filling tube (30) comprising the tube having the long length to prevent the filling tube (30) from being twisted, wherein a coil spring (31) is provided in a portion of the filling tube (30) guided by the protrusion part (11) to prevent the filling tube (30) from being bent such that the filled CN solution is smoothly sprayed.

4. The self-defense spray of claim 1, wherein an inclined surface (24*b*) is formed on a top surface of the locking rim (24) formed under the introduction hole (23*a*) communicating with the longitudinally-formed supply passage (23) of the supply tube (22), a corresponding inclined surface identical to the inclines surface (24*b*) is formed at an inner wall of the packing (28), which is positioned at the top surface of the locking rim (24) and fitted to seal the introduction hole (23*a*), such that the packing (28) fitted to seal the introduction hole (23*a*) is simultaneously pressed as the supply tube (22) is pressed through the pumping operation by the button member (40) to generate a vacuum pressure, and then the supply tube (22) is more pressed, such that the inclined surface (24*b*) is spaced apart from the corresponding inclined surface of the packing (28) which is engaged with the inclined surface to open the introduction hole (23*a*) to introduce the CN solution into the supply passage (23).

5. The self-defense spray of claim 1, wherein, if the filled CN solution is determined as being completely exhausted by opening the cap (50) installed to clog the opposite side of the filling tube (30), the opposite side of the filling tube (30) is inserted into an additional container to receive the CN solution and a pumping operation is performed by consecutively pressing the button member (40) such that the vacuum is generated from the vacuum pump operating member (20) to suck the CN solution received in the additional container by the compressive force.

6. The self-defense spray of claim 5, wherein the cap (50) has a tubular shape and has one side formed therein with a coupling tube (50*a*) communicating with the filling tube (30), a fastening member (51) is provided at an opposite side of the cap (50) having the tubular shape and finished to seal the cap (50) by inserting the fastening member (51) into the cap (50) through a screw-fastening scheme, and the fastening member (51) is open from the cap (50) or closed to the cap (50) through the screw-fastening scheme such that the CN solution is easily filled.

7. The self-defense spray of claim 6, further comprising a fluid passage hole formed in one side of the fastening member (51) such that the fastening member (51) is screw-adjusted to an extent that the fluid passage hole is exposed to facilitate filling of the CN solution.

* * * * *